US007700064B2

(12) United States Patent
Sakurai et al.

(10) Patent No.: US 7,700,064 B2
(45) Date of Patent: Apr. 20, 2010

(54) CARBON FIBER

(75) Inventors: Hiroshi Sakurai, Iwakuni (JP); Tetsuo Ban, Iwakuni (JP); Masumi Hirata, Iwakuni (JP); Toru Sawaki, Iwakuni (JP)

(73) Assignee: Teijin Limited, Osaka (JP)

( * ) Notice: Subject to any disclaimer, the term of this patent is extended or adjusted under 35 U.S.C. 154(b) by 452 days.

(21) Appl. No.: 10/592,153

(22) PCT Filed: Nov. 16, 2004

(86) PCT No.: PCT/JP2004/017324

§ 371 (c)(1),
(2), (4) Date: Feb. 5, 2007

(87) PCT Pub. No.: WO2005/087991

PCT Pub. Date: Sep. 22, 2005

(65) Prior Publication Data

US 2007/0184348 A1 Aug. 9, 2007

(30) Foreign Application Priority Data

Mar. 11, 2004 (JP) ..... 2004-068748
Mar. 12, 2004 (JP) ..... 2004-070291

(51) Int. Cl.

| | |
|---|---|
| ***D01F 9/12*** | (2006.01) |
| ***C01D 3/00*** | (2006.01) |
| ***C01B 31/02*** | (2006.01) |
| ***C01B 3/26*** | (2006.01) |
| ***C09C 1/48*** | (2006.01) |
| ***D02G 3/00*** | (2006.01) |
| ***B32B 3/26*** | (2006.01) |
| ***B32B 9/00*** | (2006.01) |
| ***D01D 5/10*** | (2006.01) |
| ***D01D 5/08*** | (2006.01) |
| ***C01B 31/08*** | (2006.01) |

(52) U.S. Cl. ..... 423/447.1; 423/449.2; 423/461; 423/652; 423/458; 423/453; 428/367; 428/304.4; 428/318.4; 502/418; 502/423

(58) Field of Classification Search ..... None
See application file for complete search history.

(56) References Cited

U.S. PATENT DOCUMENTS

| | | | | |
|---|---|---|---|---|
| 4,435,375 | A * | 3/1984 | Tamura et al. | 423/439 |
| 4,572,813 | A | 2/1986 | Arakawa | |
| 2006/0012061 | A1 | 1/2006 | Hirata et al. | |

FOREIGN PATENT DOCUMENTS

| | | | |
|---|---|---|---|
| CN | 1685095 | A | 10/2005 |

(Continued)

OTHER PUBLICATIONS

Howe et al.; Influence of Boron on Structure and Oxidation Behavior of Graphite Fiber, P120; Carbon; 42, pp. 461-467; 2004.*

(Continued)

*Primary Examiner*—Melvin C Mayes
*Assistant Examiner*—Guinever S Gregorio
(74) *Attorney, Agent, or Firm*—Sughrue Mion, PLLC

(57) ABSTRACT

A carbon fiber having a total content of Li, Na, Ti, Mn, Fe, Ni and Co metal elements of no more than 50 ppm and a fiber diameter of 0.001 to 2 μm and not branched and a assembly of a plurality of the carbon fibers.

11 Claims, 2 Drawing Sheets

FOREIGN PATENT DOCUMENTS

| | | | |
|---|---|---|---|
| EP | 1550747 | A1 | 7/2005 |
| EP | 1666649 | A1 | 6/2006 |
| EP | 1686208 | A1 | 8/2006 |
| JP | 60-027700 | A | 2/1985 |
| JP | 60-054998 | A | 3/1985 |
| JP | 63-293164 | A | 11/1988 |
| JP | 01-282349 | A | 11/1989 |
| JP | 1-282349 | A | 11/1989 |
| JP | 1-314734 | A | 12/1989 |
| JP | 382822 | A | 4/1991 |
| JP | 7-150419 | A | 6/1995 |
| JP | 2778434 | B2 | 7/1998 |
| JP | 2000-264602 | A | 9/2000 |
| JP | 2000-327317 | A | 11/2000 |
| JP | 2001-073226 | A | 3/2001 |
| JP | 2002-18281 | A | 1/2002 |
| JP | 2002-29719 | A | 1/2002 |
| JP | 2002-146634 | A | 5/2002 |
| JP | 2002-348741 | A | 12/2002 |
| JP | 2003-49329 | A | 2/2003 |
| JP | 2003-301335 | A | 10/2003 |
| JP | 2003-336130 | A | 11/2003 |
| JP | 2004-3097 | A | 1/2004 |
| JP | 200436038 | A | 2/2004 |
| JP | 2004176236 | A * | 6/2004 |

OTHER PUBLICATIONS

Ma et al.; Processing, Structure, and Properties of Fibers from Polyester/Carbon Nanofiber Composites; Composites Science and Technologies; 63, 1617-1628; 2003.*

Carbon Fibers, Encyclopedia of Materials: Science and Technology.*

Machine Translation of JP 2003-336130 A Hiroshi et al.*

* cited by examiner

CARBON FIBER

TECHNICAL FIELD

The present invention relates to a carbon fiber. More specifically, it relates to an extrafine carbon fiber manufactured from a mixture of a thermoplastic resin and a thermoplastic carbon precursor.

BACKGROUND ART

Since carbon fibers have excellent characteristic properties such as high strength, a high elastic modulus, high conductivity and light weight, they are used as fillers for high-performance composite materials. They are used as reinforcing fillers for the improvement of mechanical strength as in the prior art and further expected to be used as electromagnetic shielding materials, conductive resin fillers for antistatic materials and fillers for the electrostatic coating of a resin to use electric conductivity which the carbon fibers have. Making use of their features such as chemical stability, thermal stability and a micro-structure as a carbon material, they are expected to be used as field electron emitting materials in a flat display or the like.

As means of manufacture a carbon fiber for high-performance composite materials, (1) a process of manufacturing a carbon fiber by a vapor phase method and (2) a process of manufacturing a carbon fiber by melt spinning a resin composition have been reported.

As the process of manufacturing a carbon fiber by a vapor phase method, there are disclosed one in which an organic compound such as benzene is used as a raw material, an organic transition metal compound such as ferrocene is introduced as a catalyst into a high-temperature reaction furnace together with a carrier gas, and a carbon fiber is produced on a board (refer to JP-A 60-27700, particularly pages 2 to 3), one in which a carbon fiber is produced by a vapor phase method in a suspended state (refer to JP-A 60-54998, particularly pages 1 to 2) and one in which a carbon fiber is grown on the wall of a reaction furnace (refer to U.S. Pat. No. 2,778,434, particularly pages 1 to 2).

Although the carbon fibers obtained by these processes have high strength and a high elastic modulus, they are mostly branched and very inferior in performance as a reinforcing filler. Further, they have a high metal content because a metal catalyst is used. Therefore, when they are mixed with a resin, they deteriorate the resin by a catalytic function.

Meanwhile, as the process of manufacturing a carbon fiber by melt spinning a resin composition, one in which an extrafine carbon fiber is manufactured from a composite fiber of a phenolic resin and polyethylene (refer to JP-A 2001-73226, particularly pages 3 to 4) is disclosed. Although a carbon fiber having a small number of branched structures is obtained by this process, the phenolic resin is completely amorphous and therefore is hardly aligned and difficult to be graphitized, thereby making it impossible to expect the development of the strength and elastic modulus of the obtained extrafine carbon fiber.

DISCLOSURE OF THE INVENTION

It is an object of the present invention to provide an extrafine carbon fiber which has a low metal element content and does not deteriorate a resin when it is mixed with the resin.

It is another object of the present invention to provide an extrafine carbon fiber which has no branched structure and can be advantageously used as a reinforcing filler for resins.

Other objects and advantages of the present invention will become apparent from the following description.

According to the present invention, firstly, the above objects and advantages of the present invention are attained by a single carbon fiber which has (1) a metal element content of no more than 50 ppm and (2) a fiber diameter of 0.001 to 2 μm and (3) is not branched.

According to the present invention, secondly, the above objects and advantages of the present invention are attained by an assembly of a plurality of the above carbon fibers of the present invention whose fiber axes are distributed at random.

PREFERABLE EMBODIMENT OF THE INVENTION

Figure 1:
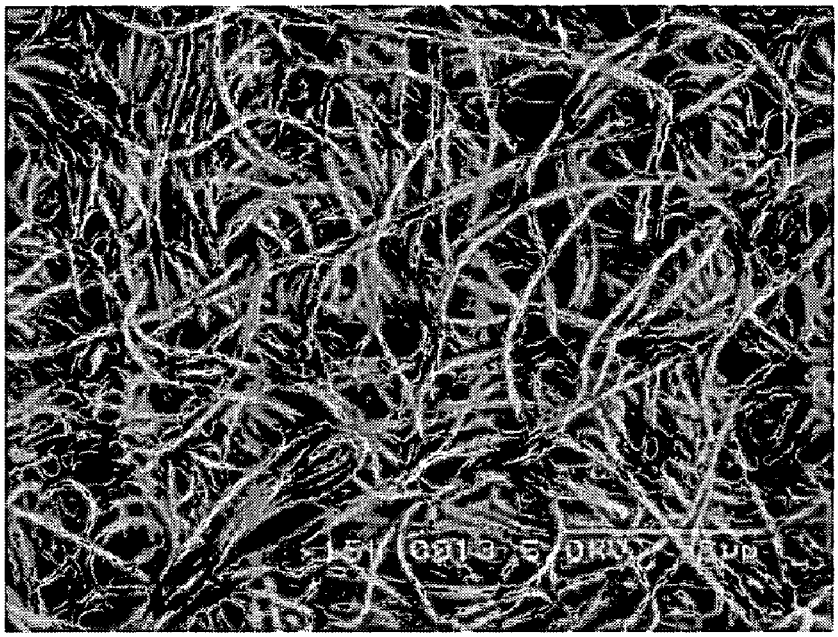
FIG. 1 is a photomicrograph (magnification of 15,000×) of carbon fibers obtained in Example 1 taken by an electron scanning microscope (S-2400 of Hitachi, Ltd.)

The single carbon fiber of the present invention has a metal element content of no more than 50 ppm. When the total metal content is higher than 50 ppm and the carbon fiber is used as a reinforcement for a resin, the resin is readily deteriorated by the catalytic function of a metal. The total metal content is preferably 20 ppm. This metal element content is preferably the total content of Li, Na, Ti, Mn, Fe, Ni and Co. Out of these, the content of Fe in particular is preferably 5 ppm or less. When the content of Fe is higher than 5 ppm, a resin is readily deteriorated in a blend of the fiber and the resin disadvantageously. The content of Fe is more preferably 3 ppm or less, much more preferably 1 ppm or less. Preferably, the carbon fiber of the present invention contains boron which is a non-metal element in an amount of 0.5 to 100 ppm.

In general, graphite is a metalloid in which the valence band and the conduction band slightly overlap with each other. When a substitutional solid solution of boron having one less electrons than graphite is existent in this graphite structure, it becomes an electron hole type metal, whereby the improvement of electric conductivity can be expected. It is known that the actual substitutional solid solution of boron becomes an acceptor to increase the concentration of electron holes. Although the amount of boron which can be substituted and solid dissolved is extremely small as thermodynamic equilibrium, it is also known that the above amount is very large as compared with the number of graphite carriers and that the influence upon physical properties of the substitutional solid solution of a slight amount of boron is very large. To obtain the target effect of the present invention, the content of boron must be 0.5 ppm or more. When the content of boron is higher than 100 ppm, the high crystallinity of the finally obtained extrafine carbon fiber is destroyed, which leads to a reduction in electric conductivity disadvantageously.

To obtain higher electric conductivity, the content of boron is preferably 1.0 to 50 ppm, more preferably 2.0 to 10 ppm.

The carbon fiber of the present invention has a fiber diameter (D) of 0.001 to 2 μm. When the fiber diameter of the carbon fiber is larger than 2 μm, the performance of the fiber as a filler for high-performance composite materials greatly deteriorates disadvantageously. When the fiber diameter is smaller than 0.001 μm, the bulk density of the fiber becomes very small and the handling of the fiber becomes difficult disadvantageously. The carbon fiber of the present invention has a ratio (L/D) of the fiber length (L) to the fiber diameter (D) of preferably 2 to 1,000, more preferably 5 to 500.

The carbon fiber of the present invention is not branched. Since a carbon fiber manufactured by the vapor phase method has a large number of branched structures, the turbulence of the graphite structure, that is, a grain structure is observed due to the branched structures, thereby reducing the elastic modulus and strength of the carbon fiber itself. The dispersibility in a resin of the carbon fiber is reduced by the entanglement of branched carbon fibers.

However, it is seen by a transmission electron microscope or electron beam diffraction that the carbon fiber of the present invention is not branched and that a grain structure which is observed in a carbon fiber manufactured by the vapor phase method is very rare, whereby not only high strength and a high elastic modulus are expected but also the dispersibility in a resin of the carbon fiber is high advantageously.

Preferably, the carbon fiber of the present invention has a carbon element content of at least 98 wt %. The carbon element is preferably graphite carbon. When the carbon element content is lower than 98 wt %, a large number of defects are produced in the internal structure of a graphite layer with the result that the mechanical strength and elastic modulus of the carbon fiber are apt to lower. The carbon content is more preferably 99 wt % or more.

The carbon fiber of the present invention has hydrogen, nitrogen, oxygen and ash contents of 0.5 wt % or less, respectively.

When the content of any one of hydrogen, nitrogen, oxygen and ash in the carbon fiber is 0.5 wt % or less, the structural defects of the graphite layer are more suppressed, thereby causing no reduction in mechanical strength and elastic modulus. The contents of hydrogen, nitrogen, oxygen and ash in the carbon fiber are more preferably 0.3 wt % or less.

As described above, the carbon fiber of the present invention is preferably made up of graphite, more preferably graphite having a structure that a plurality of graphenes, that is, carbon hexagonal netplanes spread infinitely and are assembled together by Van der Waals force. In the carbon fiber of the present invention having this structure, the above structure, that is, graphenes are bonded together by a carbon bridge at the end of the carbon fiber.

In the present invention, when the graphite layer has the above structure, the turbulence of the graphite layer of the whole carbon fiber is suppressed, thereby making it possible to obtain a carbon fiber having a high elastic modulus and high strength.

The carbon fiber of the present invention is preferably such that a plurality of graphene layers align substantially in the fiber axial direction and graphenes on the surface other than the end of the carbon fiber are not bonded together by a carbon bridge.

The expression "a plurality of graphenes align substantially in the fiber axial direction" as used herein means that a plurality of graphene layers take a fibrous shape as a whole while graphenes are made uniform and bundled up. The expression "graphenes on the surface other than the end of the carbon fiber are not bonded together by a carbon bridge" means that graphenes bonded by the above carbon bridge are not exposed to a portion other than the end of the carbon fiber.

If the carbon fiber has the above structure, the turbulence of the graphene layers of the carbon fiber as a whole is further suppressed, thereby making it possible to obtain a carbon fiber having a high elastic modulus and high strength.

Further, the carbon fiber of the present invention has an R value defined by the following equation and measured by Raman spectroscopy of the external surface of the carbon fiber of 0.08 to 0.2:

$$R=I_{1355}/I_{1580}$$

wherein $I_{1355}$ and $I_{1580}$ are the strengths of a Raman band at 1,355 $cm^{-1}$ and 1,580 $cm^{-1}$, respectively.

When the R value is 0.08 or more, the edge face of graphite is fully exposed to the surface of the fiber advantageously and when the R value is 0.2 or less, the degree of graphitization becomes sufficiently high advantageously. The R value is more preferably 0.09 to 0.18, particularly preferably 0.10 to 0.17.

The R value is a parameter effective for the evaluation of a specimen having a high degree of graphitization. It is known that the R value of even a specimen having the same degree of graphitization differs, depending on whether the surface of the graphite layer or the edge face of the graphite layer is seen.

Whether the edge face or the surface of the graphite layer is observed can be judged from this fact by analyzing a Raman band parameter in detail.

Preferably, the carbon fiber of the present invention has a half-value width (Δ1580) of a Raman band at around 1,580 $cm^{-1}$ measured for the external surface of the carbon fiber of 25 $cm^{-1}$ or less. In general, Δ1580 depends on the degree of graphitization. As the degree of graphitization increases, Δ1580 becomes sharper. When Δ1580 is 25 $cm^{-1}$ or less, the degree of graphitization becomes more satisfactory. Δ1580 is more preferably in the range of 23 $cm^{-1}$ or less.

Preferably, the carbon fiber of the present invention has a distance ($d_{002}$) between adjacent graphite sheets obtained by wide-angle X-ray measurement of 0.335 to 0.360 nm and a graphene (a group of netplanes) thickness (Lc) of 1.0 to 150 nm.

When $d_{002}$ is outside the range of 0.335 to 0.360 nm, the strength of the carbon fiber tends to greatly lower, when the thickness (Lc) of the above group of netplanes is smaller than 1.0 nm, the elastic modulus of the carbon fiber greatly drops, and when Lc is larger than 150 nm, the strength tends to greatly lower though the elastic modulus of the carbon fiber greatly increases. More preferably, the carbon fiber having high strength and a high elastic modulus has a ($d_{002}$) of 0.335 to 0.340 nm and an (Lc) of 10 to 130 nm.

The carbon fiber of the present invention has streak-like irregularities extending in the fiber axial direction preferably on the exterior surface of the fiber in its appearances. The carbon fiber is preferably solid.

The single carbon fiber of the present invention is characterized as described above. According to the present invention, there is also provided an assembly of a plurality of the carbon fibers of the present invention whose fiber axes are distributed at random.

The above assembly of the carbon fibers may further contain branched carbon fibers.

In this case, preferably, the branched carbon fibers have (1) a fiber diameter of 0.001 to 2 μm and (2) are branched. The branched carbon fibers may be hollow fibers, for example, carbon fibers called "nanotube". The content of the branched carbon fibers is preferably 50 wt % or less based on the total of the non-branched carbon fibers of the present invention and the branched carbon fibers.

These branched carbon fibers and nanotubes can be manufactured by a method known per se.

The assembly of carbon fibers of the present invention may contain carbon particles having an aspect ratio of less than 2 and a primary particle diameter of less than 1 μm in an amount of 20 wt % or less based on the total of carbon fibers.

According to the present invention, the non-branched carbon fibers of the present invention can be manufactured by the following method, for example. This method basically comprises the steps of:

(1) forming a precursor fiber from a mixture of 100 parts by weight of a thermoplastic resin and 1 to 150 parts by weight of at least one thermoplastic carbon precursor selected from the group consisting of a pitch, polyacrylonitrile, polycarbodiimide, polyimide, polybenzoazole and aramide;
(2) forming a stabilized precursor fiber by subjecting the precursor fiber to a stabilization treatment under an oxygen or oxygen/iodine mixed gas atmosphere;
(3) forming a fibrous carbon precursor by removing the thermoplastic resin from the stabilized precursor fiber; and
(4) carbonizing or graphitizing the fibrous carbon precursor.

The carbon fiber which satisfies the above conditions is manufactured from a mixture of a thermoplastic resin and a thermoplastic carbon precursor. A description is subsequently given of (1) the thermoplastic resin and (2) the thermoplastic carbon precursor and then of (3) the process for manufacturing a mixture from the thermoplastic resin and the thermoplastic carbon precursor and (4) the process for manufacturing a carbon fiber from the mixture.

(1) Thermoplastic Resin

The thermoplastic resin must be easily removed after the manufacture of the stabilized precursor fiber. Therefore, a thermoplastic resin which is decomposed to preferably 15 wt % or less, more preferably 10 wt % or less, much more preferably 5 wt % or less of its initial weight when it is kept at a temperature of 350° C. or higher and lower than 600° C. for 5 hours under an oxygen or inert gas atmosphere is used.

Preferred examples of this thermoplastic resin include polyolefins, polyacrylate-based polymers such as polymethacrylates and polymethyl methacrylate, polystyrenes, polycarbonates, polyallylates, polyester carbonates, polysulfones, polyimides and polyether imides. Out of these, polyolefin-based thermoplastic resins represented by the following formula (I) and polyethylene are preferably used as a thermoplastic resin which has high gas permeability and can be easily thermally decomposed.

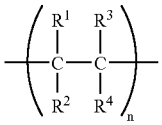

(I)

wherein $R^1$, $R^2$, $R^3$ and $R^4$ are each independently a hydrogen atom, alkyl group having 1 to 15 carbon atoms, cycloalkyl group having 5 to 10 carbon atoms, aryl group having 6 to 12 carbon atoms or aralkyl group having 7 to 12 carbon atoms, and n is an integer of 20 or more.

Illustrative examples of the compound represented by the above formula (I) include poly-4-methylpentene-1, poly-4-methylpentene-1 copolymers such as copolymers of poly-4-methylpentene-1 and a vinyl-based monomer, and polyethylene. Examples of the polyethylene include ethylene homopolymers such as low-density polyethylene produced by high pressure method, medium-density polyethylene, high-density polyethylene and linear low-density polyethylene, and copolymers of ethylene and an α-olefin; and copolymers of ethylene and other vinyl-based monomer such as a copolymer of ethylene and vinyl acetate.

Examples of the α-olefin to be copolymerized with ethylene include propylene, 1-butene, 1-hexene and 1-octene. Examples of the other vinyl-based monomer include vinyl esters such as vinyl acetate; and (meth)acrylic acids such as (meth)acrylic acid, methyl(meth)acrylate, ethyl(meth)acrylate and n-butyl(meth)acrylate, and alkyl esters thereof.

Preferably, the thermoplastic resin of the present invention has a glass transition temperature of 250° C. or lower when it is amorphous and a crystal melting point of 300° C. or lower when it is crystalline because it can be easily melt kneaded with the thermoplastic carbon precursor.

(2) Thermoplastic Carbon Precursor

The thermoplastic carbon precursor used in the present invention is preferably a thermoplastic carbon precursor 80 wt % or more of the initial weight of which remains after it is kept at a temperature of 200° C. or higher and lower than 350° C. for 2 to 30 hours and then at 350° C. or higher and lower than 500° C. for 5 hours under an oxygen or oxygen/iodine mixed gas atmosphere. When the amount of the residue is smaller than 80 wt % of the initial weight under the above conditions, a carbon fiber cannot be obtained from the thermoplastic carbon precursor at a satisfactory carbonization rate disadvantageously.

More preferably, 85 wt % or more of the initial weight remains under the above conditions. Examples of the thermoplastic carbon precursor which satisfies the above conditions include rayon, pitch, polyacrylonitrile, poly-α-chloroacrylonitrile, polycarbodiimide, polyimide, polyether imide, polybenzoazole and aramide. Out of these, pitch, polyacrylonitrile and polycarbodiimide are preferred, and pitch is more preferred.

Mesophase pitch which is generally expected to have high strength and a high elastic modulus is particularly preferred. Mesophase pitch is a compound which can form an optically anisotropic phase (liquid crystal phase) in a molten state. The coal or petroleum residue after distillation or an organic compound may be used as the raw material of the mesophase pitch but mesophase pitch obtained from an aromatic hydrocarbon such as naphthalene is preferred as it is easily stabilized and carbonized or graphitized. The above thermoplastic carbon precursor may be used in an amount of preferably 1 to 150 parts by weight, more preferably 5 to 100 parts by weight based on 100 parts by weight of the thermoplastic resin.

(3) Manufacture of a Mixture of a Thermoplastic Resin and a Thermoplastic Carbon Precursor The mixture used in the present invention is manufactured from a thermoplastic resin and a thermoplastic carbon precursor. To manufacture a carbon fiber having a fiber diameter of 2 μm or less from the mixture used in the present invention, the dispersion diameter into the thermoplastic resin of the thermoplastic carbon precursor is preferably 0.01 to 50 μm.

When the dispersion diameter into the thermoplastic resin (I) of the thermoplastic carbon precursor is outside the range of 0.01 to 50 μm, it may be difficult to manufacture a carbon fiber for high-performance composite materials. The dispersion diameter of the thermoplastic carbon precursor is more preferably 0.01 to 30 μm. After the mixture of the thermoplastic resin and the thermoplastic carbon precursor is kept at 300° C. for 3 minutes, the dispersion diameter into the thermoplastic resin of the thermoplastic carbon precursor is preferably 0.01 to 50 μm.

Although the thermoplastic carbon precursor generally condenses along the passage of time when the mixture obtained by melt kneading the thermoplastic resin with the thermoplastic carbon precursor is kept in a molten state, when the dispersion diameter of the thermoplastic carbon precursor exceeds 50 μm by its condensation, it may be difficult to manufacture a carbon fiber for high-performance composite materials.

As for the condensation rate of the thermoplastic carbon precursor which changes according to the types of the thermoplastic resin and the thermoplastic carbon precursor in use, a dispersion diameter of 0.01 to 50 μm is maintained for preferably 5 minutes or longer at 300° C., more preferably for 10 minutes or longer at 300° C. The thermoplastic carbon precursor in the mixture forms an island phase and becomes spherical or oval. The term "dispersion diameter" as used herein means the diameter of the spherical thermoplastic carbon precursor or the long axis diameter of the oval thermoplastic carbon precursor in the mixture.

The amount of the thermoplastic carbon precursor is 1 to 150 parts by weight, preferably 5 to 100 parts by weight based on 100 parts by weight of the thermoplastic resin. When the amount of the thermoplastic carbon precursor is larger than 150 parts by weight, a thermoplastic carbon precursor having a desired dispersion diameter cannot be obtained and when the amount is smaller than 1 part by weight, the target carbon fiber cannot be manufactured at a low cost.

As means of manufacturing the mixture of the thermoplastic resin and the thermoplastic carbon precursor, kneading in a molten state is preferred. A known method may be employed as required to melt knead the thermoplastic resin with the thermoplastic carbon precursor. Examples of the kneader used for this purpose include a single-screw melt kneading extruder, double-screw melt kneading extruder, mixing roll and Banbury mixer. Out of these, a same-direction rotary double-screw melt kneading extruder is preferably used to finely disperse the above thermoplastic carbon precursor into the thermoplastic resin.

Melt kneading is preferably carried out at a temperature of 100 to 400° C. When the melt kneading temperature is lower than 100° C., the thermoplastic carbon precursor is not molten and it is difficult to finely disperse it into the thermoplastic resin. When the melt kneading temperature is higher than 400° C., the decomposition of the thermoplastic resin and the thermoplastic carbon precursor proceed disadvantageously. The melt kneading temperature is more preferably 150 to 350° C. The melt kneading time is 0.5 to 20 minutes, preferably 1 to 15 minutes. When the melt kneading time is shorter than 0.5 minute, the fine dispersion of the thermoplastic carbon precursor becomes difficult disadvantageously. When the melt kneading time is longer than 20 minutes, the productivity of the carbon fiber greatly drops disadvantageously.

In the present invention, to manufacture the mixture from the thermoplastic resin and the thermoplastic carbon precursor by melt kneading, they are preferably melt kneaded together under a gas atmosphere having an oxygen gas content of less than 10 vol %. The thermoplastic carbon precursor used in the present invention reacts with oxygen to be modified at the time of melt kneading to become infusible, thereby preventing its fine dispersion into the thermoplastic resin. Therefore, melt kneading is carried out while an inert gas is blown to reduce the oxygen gas content as much as possible.

The oxygen gas content during melt kneading is more preferably less than 5 vol %, much more preferably less than 1 vol %. By carrying out the above method, the mixture of the thermoplastic resin and the thermoplastic carbon precursor for obtaining a carbon fiber can be manufactured.

(4) Process for Manufacturing a Carbon Fiber

The carbon fiber of the present invention can be manufactured from the above mixture of the thermoplastic resin and the thermoplastic carbon precursor. That is, the carbon fiber of the present invention is manufactured through (4-1) the step of forming a precursor fiber from a mixture of 100 parts by weight of the thermoplastic resin and 1 to 150 parts by weight of the thermoplastic carbon precursor, (4-2) the step of forming a stabilized precursor fiber by subjecting the precursor fiber to a stabilization treatment to stabilize the thermoplastic carbon precursor contained in the precursor fiber, (4-3) the step of forming a fibrous carbon precursor by removing the thermoplastic resin from the stabilized precursor fiber, and (4-4) the step of carbonizing or graphitizing the fibrous carbon precursor. Each of the above steps will be described in detail hereinunder.

(4-1) Step of Forming a Precursor Fiber from a Mixture of a Thermoplastic Resin and a Thermoplastic Carbon Precursor In the present invention, a precursor fiber is manufactured from the mixture obtained by melt kneading the thermoplastic resin with the thermoplastic carbon precursor. As means of manufacturing the precursor fiber, there is a method in which the precursor fiber is obtained by melt spinning the mixture of the thermoplastic resin and the thermoplastic carbon precursor from a spinneret. The melt spinning temperature is 150 to 400° C., preferably 180 to 350° C. The yarn take-up rate is preferably 10 m/min to 2,000 m/min.

Alternatively, a method in which the precursor fiber is formed from the mixture obtained by melt kneading the thermoplastic resin with the thermoplastic carbon precursor by a melt blow method may be employed. As for preferred melt blow conditions, the discharge die temperature is 150 to 400° C., and the gas temperature is 150 to 400° C. The gas ejection rate of the melt blow method which has an influence upon the fiber diameter of the precursor fiber is preferably 2,000 to 100 m/sec, more preferably 1,000 to 200 m/sec.

When the mixture of the thermoplastic resin and the thermoplastic carbon precursor is melt kneaded and discharged from the die, preferably, the mixture is continuously supplied into the discharge die through a pipe in a molten state after it is melt kneaded. The transfer time from melt kneading to delivery from the spinneret is preferably 10 minutes or less.

(4-2) Step of Forming a Stabilized Precursor Fiber by Subjecting the Precursor Fiber to a Stabilization Treatment to Stabilize the Thermoplastic Carbon Precursor Contained in the Precursor Fiber In the second step of the manufacturing process of the present invention, the above formed precursor fiber is subjected to a stabilization treatment to stabilize the thermoplastic carbon precursor contained in the precursor fiber so as to form a stabilized precursor fiber. The stabilization of the thermoplastic carbon precursor is a step required to obtain a carbonized or graphitized carbon fiber. When the thermoplastic resin is removed without this step, the thermoplastic carbon precursor is thermally decomposed or fused.

The stabilization method may be a known method such as a treatment with a gas stream such as oxygen or with a solution such as an acid aqueous solution. From the viewpoint of productivity, infusibilization in a gas stream is preferred. The gas component used is preferably a mixed gas containing oxygen and/or halogen gas from the viewpoints of permeability into the above thermoplastic resin and adsorption to the thermoplastic carbon precursor and further as it can quickly infusibilize the thermoplastic carbon precursor at a low temperature.

Examples of the halogen gas include fluorine gas, chlorine gas, bromine gas and iodine gas. Out of these, bromine gas and iodine gas are preferred, and iodine gas is particularly preferred. For infusibilization in a gas stream, the precursor fiber is treated at a temperature of 50 to 350° C., preferably 80 to 300° C. for 5 hours or less, preferably 2 hours or less under a desired gas atmosphere.

Although the softening point of the thermoplastic carbon precursor contained in the precursor fiber is greatly raised by the above infusibilization, the softening point becomes preferably 400° C. or higher, more preferably 500° C. or higher for the purpose of obtaining a desired extrafine carbon fiber. By carrying out the above method, the thermoplastic carbon precursor contained in the precursor fiber is stabilized to obtain a stabilized precursor fiber.

(4-3) Step of Forming a Fibrous Carbon Precursor by Removing the Thermoplastic Resin from the Stabilized Precursor Fiber In the third step of the manufacturing process of the present invention, the thermoplastic resin contained in the stabilized precursor fiber is removed by thermal decomposition. More specifically, the thermoplastic resin contained in the stabilized precursor fiber is removed to separate only the stabilized fibrous carbon precursor so as to form a fibrous carbon precursor. In this step, the thermal decomposition of the fibrous carbon precursor is suppressed as much as possible and the thermoplastic resin is removed by decomposition to separate only the fibrous carbon precursor.

The removal of the thermoplastic resin may be carried out under an oxygen-containing atmosphere or an inert gas atmosphere. When the thermoplastic resin is removed under an oxygen-containing atmosphere, it is preferably removed at a temperature of 350° C. or higher and lower than 600° C. The expression "oxygen-containing atmosphere" as used herein means a gas atmosphere having an oxygen concentration of 1 to 100% which may contain carbon dioxide, nitrogen and inert gas such as argon, iodine or bromine besides oxygen. Out of these, air is particularly preferred from the economical point of view.

When the temperature for removing the thermoplastic resin contained in the stabilized precursor fiber is lower than 350° C., though the thermal decomposition of the fibrous carbon precursor can be suppressed, the thermal decomposition of the thermoplastic resin cannot be carried out fully. When the temperature is 600° C. or higher, though the thermal decomposition of the thermoplastic resin can be carried out fully, the thermal decomposition of the fibrous carbon precursor occurs as well with the result that the carbonization yield of the carbon fiber obtained from the thermoplastic carbon precursor drops disadvantageously.

The temperature for decomposing the thermoplastic resin contained in the stabilized precursor fiber is preferably 380 to 500° C. under an oxygen atmosphere. The decomposition is preferably carried out by heating the stabilized precursor fiber at a temperature of 400 to 450° C. for 0.5 to 10 hours. The thermoplastic resin is decomposed to 15 wt % or less of its initial weight by carrying out the above treatment. 80 wt % or more of the initial weight of the thermoplastic carbon precursor remains as a fibrous carbon precursor.

To remove the thermoplastic resin under an inert gas atmosphere, it is preferably removed at a temperature of 350° C. or higher and lower than 600° C. The term "inert gas atmosphere" as used herein means a gas such as carbon dioxide, nitrogen or argon gas having an oxygen content of 30 ppm or less, preferably 20 ppm or less. A halogen gas such as iodine or bromine may be contained.

The inert gas used in this step is preferably carbon dioxide or nitrogen, particularly preferably nitrogen from the economic point of view. When the temperature for removing the thermoplastic resin contained in the stabilized precursor fiber is lower than 350° C., though the thermal decomposition of the fibrous carbon precursor is suppressed, the thermal decomposition of the thermoplastic resin cannot be carried out fully disadvantageously.

When the above temperature is 600° C. or higher, though the thermal decomposition of the thermoplastic resin can be carried out fully, the thermal decomposition of the fibrous carbon precursor occurs as well with the result that the carbonization yield of the carbon fiber obtained from the thermoplastic carbon precursor drops disadvantageously.

The temperature for decomposing the thermoplastic resin contained in the stabilized precursor fiber is preferably 380 to 550° C. under an inert gas atmosphere. For this decomposition, the stabilized precursor fiber is particularly preferably heated at 400 to 530° C. for 0.5 to 10 hours. The thermoplastic resin used is decomposed to 15 wt % or less of its initial weight by the above treatment. 80 wt % or more of the initial weight of the thermoplastic carbon precursor used remains as a fibrous carbon precursor.

Further, as an alternative method of forming a fibrous carbon precursor by removing the thermoplastic resin from the stabilized precursor fiber, one in which the thermoplastic resin is removed by a solvent may be employed. In this method, the dissolution of the fibrous carbon precursor in the solvent is suppressed as much as possible, the thermoplastic resin is removed by decomposition, and only the fibrous carbon precursor is separated.

To satisfy this condition, in the present invention, it is preferred to remove the thermoplastic resin contained in the fibrous carbon precursor by a solvent having a temperature of 30 to 300° C. When the temperature of the solvent is lower than 30° C., it takes a lot of time to remove the thermoplastic resin contained in the precursor fiber disadvantageously. When the temperature is 300° C. or higher, though it is possible to remove the thermoplastic resin in a short period of time, not only the fibrous carbon precursor is dissolved and its fiber structure is destroyed but also the carbonization yield of the finally obtained carbon fiber based on the raw material drops disadvantageously. The temperature for removing the thermoplastic resin from the stabilized precursor fiber by the solvent is preferably 50 to 250° C., particularly preferably 80 to 200° C.

(4-4) Step of Carbonizing or Graphitizing the Fibrous Carbon Precursor

The fourth step is to manufacture a carbon fiber by carbonizing or graphitizing the fibrous carbon precursor from which the thermoplastic resin has been removed to 15 wt % or less of its initial weight under an inert gas atmosphere. In the present invention, the fibrous carbon precursor is carbonized or graphitized at a high-temperature treatment under an inert gas atmosphere to become a desired carbon fiber. The obtained carbon fiber has a fiber diameter of 0.001 to 2 μm.

The carbonization or graphitization of the fibrous carbon precursor may be carried out by a known method. The inert gas used is nitrogen or argon. The temperature is 500 to 3,500° C., preferably 800 to 3,000° C. The oxygen concentration for carbonization or graphitization is preferably 20 ppm or less, more preferably 10 ppm or less. By carrying out the above method, the carbon fiber of the present invention can be manufactured.

EXAMPLES

The following Examples are provided for the purpose of further illustrating the present invention but are in no way to be taken as limiting.

The evaluation items in the Examples were carried out as follows.

The metal element content of the carbon fiber was measured as follows. 0.02 g of the carbon fiber was collected in a Teflon beaker and thermally decomposed with nitric acid, sulfuric acid, perchloric acid and hydrofluoric acid, thermally concentrated until a white smoke of sulfuric acid is generated and thermally dissolved by adding diluted nitric acid, and then its volume was determined with diluted nitric acid. Metals contained in the obtained solution were evaluated by an ICP emission spectral analyzer (Optima 4300DV of Perkin Elmer Co., Ltd.).

The dispersed particle diameter of the thermoplastic carbon precursor contained in the mixture of the thermoplastic resin and the thermoplastic carbon precursor, the fiber diameters of the stabilized precursor fiber and the carbon fiber and the existence of a branched structure were measured by a super high-resolution field emission scanning electron microscope (UHR-FE-SEMS-5000 of Hitachi, Ltd.).

The weights of carbon, hydrogen and nitrogen contained in the carbon fiber were measured by the vario EL fully automatic elemental analyzer (sample decomposition furnace: 950° C., flow rate of helium: 200 ml/min, flow rate of oxygen: 20-25 ml/min), and the weight of oxygen was measured by the HERAEUS CHN—O RAPID fully automatic analyzer (sample decomposition furnace: 1,140° C., flow rate of $N_2/H_2$ (95%/5%) mixed gas: 70 ml/min). The weight of ash was measured by strongly heating 0.60 g of a sample in a platinum crucible at 1,100° C. for 5 hours to ash it and using the Mettler AT261 balance (minimum reading: 0.01 mg). The boron element contents of mesophase pitch and carbon fiber were measured as follows.

1.0 g of a sample was weighed and placed in a platinum crucible, 4 ml of a 3% aqueous solution of calcium hydroxide was added to the crucible to be mixed with the sample, and then the resulting mixture was ashed at 880° C. (in accordance with the method of JIS R7223).

The ash was dissolved in diluted hydrochloric acid and its volume was determined to prepare a measurement solution. This solution was measured for the determination of element B by ICP emission spectral analysis (ICPS-8000 of Shimadzu Corporation) to obtain the element B content of the sample.

Graphite on the surface of the carbon fiber was observed through a transmission electron microscope (H-9000UHR of Hitachi, Ltd.).

The Raman measurement of the carbon fiber was conducted with a Raman spectrometer (Ramanor T-64000 of Jobin Yvon Co., Ltd.).

The $(I_{1355}/I_{1580})$ value and the parameter of a Raman band at Δ1580 were obtained by fitting the shape of a spectrum with a Lorentz function by the method of least square.

For the wide-angle X-ray measurement of the carbon fiber, the RU-300 of Rikagaku Denki Co., Ltd. was used.

The distance $(d_{002})$ between netplanes was obtained from the value of 2θ, and the thickness (Lc) of a group of netplanes was obtained from the half-value width of a peak.

Example 1

Figure 2:
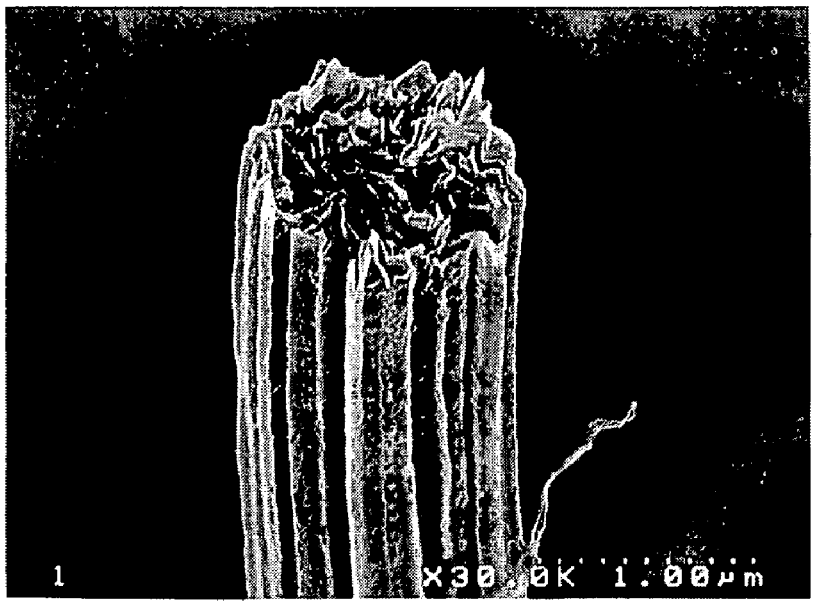
FIG. 2 is a photomicrograph (magnification of 30,000×) of the end of the carbon fiber obtained in Example 1 taken by an electron scanning microscope (S-2400 of Hitachi, Ltd.)

100 parts by weight of poly-4-methylpentene-1 (TPX: Grade RT-18 [of Mitsui Chemical, Inc.]) as a thermoplastic resin and 11.1 parts by weight of mesophase pitch AR-HP (of Mitsubishi Gas Chemical Company Inc.) as a thermoplastic carbon precursor were melt kneaded together by a same-direction double-screw extruder (TEX-30 of Nippon Steel Co., Ltd., barrel temperature of 290° C., in a nitrogen stream) to prepare a mixture. The dispersion diameter into the thermoplastic resin of the thermoplastic carbon precursor of the mixture obtained under this condition was 0.05 to 2 μm. When the mixture was kept at 300° C. for 10 minutes, the aggregation of the thermoplastic carbon precursor was not observed and the dispersion diameter of the thermoplastic carbon precursor was 0.05 to 2 μm. The B content of the mesophase pitch AR-HP was 1.2 ppm. Then, the above mixture was taken up by a mono-hole spinning machine at 330° C. and a rate of 1,200 m/min to manufacture a precursor fiber. 10 parts by weight of this precursor fiber and 0.5 part by weight of iodine were fed to a pressure glass container having a capacity of 1 liter together with air and kept at 180° C. for 20 hours to carry out a stabilization treatment so as to manufacture a stabilized precursor fiber. Then, the stabilized precursor fiber was heated up to 550° C. at a temperature elevation rate of 5° C./min under a nitrogen gas atmosphere to remove the thermoplastic resin so as to manufacture a fibrous carbon precursor. This fibrous carbon precursor was heated from room temperature to 2,800° C. in 3 hours under an argon atmosphere to manufacture a carbon fiber. It was confirmed by observation through an electron microscope that the obtained carbon fiber had a fiber diameter (D) of about 100 nm to 1 μm, a fiber length (L) of 2 μm or more and an L/D ratio of 2 to 1,000, substantially no branched structure was seen, and there were streak-like irregularities extending in the fiber axial direction on the exterior surface of the fiber (see FIG. 1 and FIG. 2).

It was confirmed by the elemental analysis of the obtained carbon fiber that the content of carbon was 99.7 wt % or more, the total weights of hydrogen, nitrogen, oxygen and ash were 0.3 wt % or less, the content of boron was 2.3 ppm from the quantitative analysis of boron, the contents of Li, Na, Ti, Mn, Fe, Ni and Co metal elements were all less than 5 ppm, and the content of Fe was less than 1 ppm.

Figure 3:
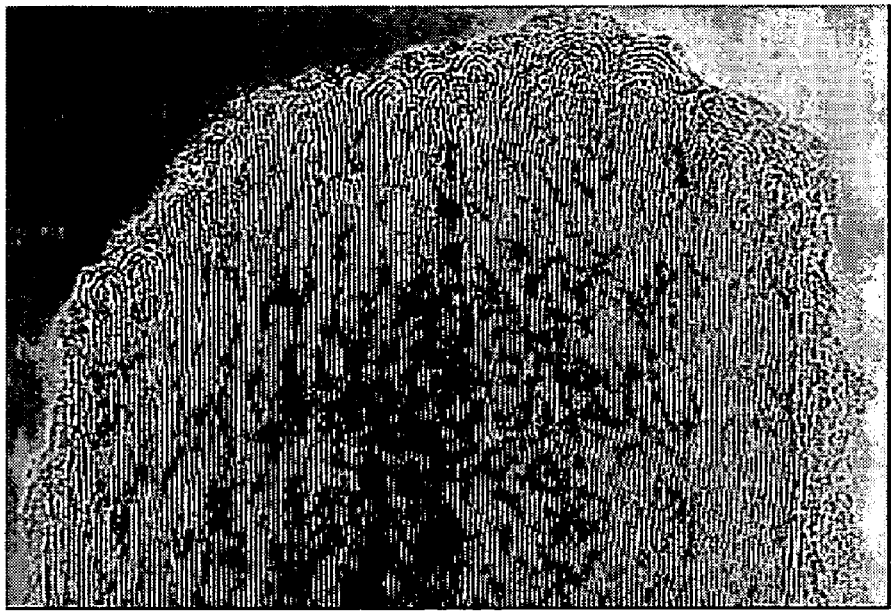
FIG. 3 is a photomicrograph (magnification of 2,500,000×) of the surface and a portion therearound of the carbon fiber obtained in Example 1 taken by a transmission electron microscope (H-9000UHR of Hitachi, Ltd.)
Figure 4:
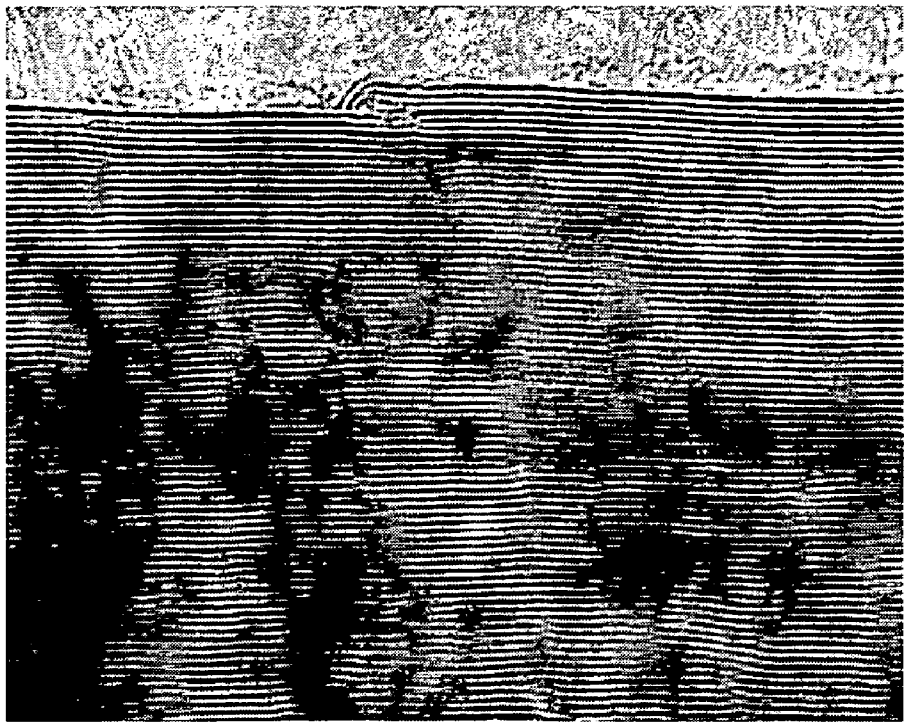
FIG. 4 is a photomicrograph (magnification of 3,750,000×) of the surface and a portion therearound of the carbon fiber obtained in Example 1 taken by a transmission electron microscope (H-9000UHR of Hitachi, Ltd.).

A photomicrograph of the obtained carbon fiber taken by a transmission electron microscope is included herein. It was confirmed from the photomicrograph taken by the transmission electron microscope that graphite highly aligned in the fiber axial direction, graphenes were bonded together by a carbon bridge at the end of the carbon fiber, and the fiber was solid (see FIG. 3 and FIG. 4). The R value evaluated by Raman spectroscopy was 0.152, the half-value width of the Raman band at 1,580 $cm^{-1}$ was 21.6, the distance $(d_{002})$ between netplanes of the graphite layer evaluated by wide-angle X-ray measurement was 0.336 nm, and the thickness (Lc) of a group of netplanes was 20.0 nm.

Example 2

100 parts by weight of poly-4-methylpentene-1 (TPX: grade RT-18 [of Mitsui Chemical, Inc.]) as a thermoplastic resin and 11.1 parts by weight of mesophase pitch AR-HP (of Mitsubishi Gas Chemical Company Inc.) as a thermoplastic carbon precursor were melt kneaded together by a same-direction double-screw extruder (TEX-30 of Nippon Steel Co., Ltd., barrel temperature of 290° C., in a nitrogen stream) to prepare a mixture. The dispersion diameter into the thermoplastic resin of the thermoplastic carbon precursor of the mixture obtained under this condition was 0.05 to 2 μm. When this mixture was kept at 300° C. for 10 minutes, the aggregation of the thermoplastic carbon precursor was not observed and the dispersion diameter thereof was 0.05 to 2 μm. The B content of the mesophase pitch AR-HP was 1.2 ppm. Then, the above mixture was taken up by a mono-hole spinning machine at 330° C. and a rate of 1,200 m/min to manufacture a precursor fiber. 10 parts by weight of this precursor fiber and 0.5 part by weight of iodine were fed to a pressure glass container having a capacity of 1 liter together with air and kept at 180° C. for 2 hours to carry out a stabilization treatment so as to manufacture a stabilized precursor fiber. Then, 10 parts by weight of the stabilized precursor fiber was dissolved in 1,000 parts by weight of a decahydronaphthalene solution at 120° C., and the resulting solution was filtered to remove the thermoplastic resin so as to obtain a fibrous carbon precursor. This fibrous carbon precursor was heated from room temperature up to 2,800° C. in 3 hours under an argon gas atmosphere to manufacture a carbon fiber. It was confirmed by observation through an electron microscope that the obtained carbon fiber had a fiber diameter (D) of about 100 to 800 nm, a fiber length (L) of about 2 to 10 μm and an L/D ratio of 2 to 50, substantially no branched structure was observed, and there were streak-like irregularities extending in the fiber axial direction on the exterior surface of the fiber.

It was confirmed by the elemental analysis of the obtained carbon fiber that the content of carbon was 99.7 wt % or more, the total weights of hydrogen, nitrogen, oxygen and ash were 0.3 wt % or less, the content of boron was 2.6 ppm from the quantitative analysis of boron, the contents of Li, Na, Ti, Mn, Fe, Ni and Co metal elements were all less than 5 ppm, and the content of Fe was less than 1 ppm.

It was confirmed from a photomicrograph of the obtained carbon fiber taken by a transmission electron microscope that graphite highly aligned in the fiber axial direction, graphenes were bonded together by a carbon bridge at the end of the carbon fiber, and the fiber was solid. The R value evaluated by Raman spectroscopy was 0.142, the half-value width of the Raman band at 1,580 $cm^{-1}$ was 22.1, the distance ($d_{002}$) between netplanes of the graphite layer evaluated by wide-angle X-ray measurement was 0.337 nm, and the thickness (Lc) of a group of netplanes was 18.0 nm.

Comparative Example 1

When the VGCF carbon fiber manufactured by vapor deposition of Showa Denko K.K. was observed through an electron microscope, it had a fiber diameter of about 100 to 300 nm and a large number of branched structures were observed in the carbon fiber. Although the contents of Li, Na, Ti, Mn, Ni and Co metal elements were all less than 5 ppm, the content of Fe was 83 ppm. The R value evaluated by Raman spectroscopy was 0.073, and the half-value width of the Raman band at 1,580 $cm^{-1}$ was 21.6. The surface of the carbon fiber evaluated by a scanning electron microscope was flat. It was confirmed by observation through a transmission electron microscope that the fiber had a hollow structure.

The invention claimed is:

1. A single carbon solid fiber which has (1) a metal element content of no more than 50 ppm and (2) a fiber diameter of 0.001 to 2 μm and (3) substantially no branched structure which is seen through an electron microscope, wherein the half-value width of the Raman band at 1,580 $cm^{-1}$ measured by Raman spectroscopy of the exterior surface of the carbon fiber is 25 $cm^{-1}$ or less, wherein the R value defined by the following equation measured by Raman spectroscopy of the exterior surface of the carbon fiber is 0.08 to 0.2, $$R=I_{1355}/I_{1580}$$

wherein $I_{1355}$ and $I_{1580}$ are the strengths of the Raman band at 1,355 $cm^{-1}$ and 1,580 $cm^{-1}$, respectively, wherein streak-like irregularities extending in the fiber axial direction are existent on the exterior surface of the fiber, wherein the ratio (L/D) of the fiber length (L) to the fiber diameter (D) is 2 to 1.000, wherein the carbon fiber is made up of graphite which is composed of a plurality of graphenes and the graphenes are bonded together by a carbon bridge at the end of the carbon fiber, wherein the graphene surface of a graphite layer is oriented in the fiber axial direction, wherein the distance ($d_{002}$) between adjacent graphite sheets is in the range of 0.335 to 0.360 nm, and the thickness (Lc) of graphenes is in the range of 1.0 to 150 nm according to wide-angle X-ray measurement.

2. The carbon fiber according to claim 1, wherein the content of elemental carbon is at least 98 wt %.

3. The carbon fiber according to claim 1 which further contains elemental boron in an amount of 0.5 to 100 ppm.

4. The carbon fiber according to claim 1, wherein the metal element content is the total content of Li, Na, Ti, Mn, Fe, Ni and Co.

5. The carbon fiber according to claim 4, wherein the content of Fe is 5 ppm or less.

6. An assembly of a plurality of the carbon fibers of claim 1 whose fiber axes are distributed at random.

7. The assembly of carbon fibers according to claim 6 which further contains branched carbon fibers.

8. An assembly of a plurality of the carbon fibers of claim 1 whose fiber axes are distributed at random, wherein the assembly further contains branched carbon fibers, wherein the content of the branched carbon fibers is 50 wt % or less based on the total of the carbon fibers of claim 1 and the branched carbon fibers.

9. The assembly of carbon fibers according to claim 7, wherein the branched carbon fibers have (1) a fiber diameter of 0.001 to 2 μm and (2) are branched.

10. The assembly of carbon fibers according to claim 6 which further contains carbon particles having an aspect ratio of less than 2 and a primary particle diameter of less than 1 μm in an amount of 20 wt % or less based on the total of carbon fibers.

11. The assembly of carbon fibers according to claim 7, wherein the branched carbon fibers are hollow.

* * * * *